US007124077B2

(12) United States Patent
Wang et al.

(10) Patent No.: US 7,124,077 B2
(45) **Date of Patent: *Oct. 17, 2006**

(54) FREQUENCY DOMAIN POSTFILTERING FOR QUALITY ENHANCEMENT OF CODED SPEECH

(75) Inventors: Hong Wang, Bellevue, WA (US); Vladimir Cuperman, Goleta, CA (US); Allen Gersho, Santa Barbara, CA (US); Hosam A. Khalil, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 57 days.

This patent is subject to a terminal disclaimer.

(21) Appl. No.: 11/045,907

(22) Filed: Jan. 28, 2005

(65) Prior Publication Data

US 2005/0131696 A1 Jun. 16, 2005

Related U.S. Application Data

(63) Continuation of application No. 09/896,062, filed on Jun. 29, 2001, now Pat. No. 6,941,263.

(51) Int. Cl.
*G10L 19/04* (2006.01)
*G10L 21/02* (2006.01)

(52) U.S. Cl. ..... 704/206; 704/209; 704/225

(58) Field of Classification Search ..... 704/203, 704/205, 206, 209, 219, 225
See application file for complete search history.

(56) References Cited

U.S. PATENT DOCUMENTS 5,067,158 A * 11/1991 Arjmand ..... 704/219
5,701,390 A * 12/1997 Griffin et al. ..... 704/206
5,752,222 A * 5/1998 Nishiguchi et al. ..... 704/201
5,812,966 A * 9/1998 Byun et al. ..... 704/207
5,890,108 A * 3/1999 Yeldener ..... 704/208
RE36,478 E * 12/1999 McAulay et al. ..... 704/206
6,047,254 A * 4/2000 Ireton et al. ..... 704/209
6,073,092 A * 6/2000 Kwon ..... 704/219
6,098,036 A * 8/2000 Zinser, Jr. et al. ..... 704/219
6,449,592 B1 * 9/2002 Das ..... 704/224
6,505,152 B1 * 1/2003 Acero ..... 704/209
6,704,711 B1 * 3/2004 Gustafsson et al. ..... 704/258
6,941,263 B1 * 9/2005 Wang et al. ..... 704/219

OTHER PUBLICATIONS

Kabal et al., "Adaptive Postfiltering for Enhancement of Noisy Speech in the Frequency Domain," Proceedings of the International Symposium on Circuits and Systems, IEEE, vol. 1, SYMP 24, pp. 312-315 (Jun. 1991).*

* cited by examiner

*Primary Examiner*—Martin Lerner
(74) *Attorney, Agent, or Firm*—Microsoft Corporation

(57) ABSTRACT

A method and system of performing postfiltering in the frequency domain to improve the quality of a speech signal, especially for synthesized speech resulting from codecs of low bit-rate, is provided. The method comprises LPC tilt computation and compensation methods and modules, a formant filter gain computation method and module, and an anti-aliasing method and module. The formant filter gain calculation employs an LPC representation, an all-pole modeling, a non-linear transformation and a phase computation. The LPC used for deriving the postfilter may be transmitted from an encoder or may be estimated from a synthesized or other speech signal in a decoder or receiver. The invention may be implemented in a linked decoder and encoder. A separate LPC evaluation unit that is responsible for processing and or deriving the LPC may be implemented within the invention.

20 Claims, 8 Drawing Sheets

FREQUENCY DOMAIN POSTFILTERING FOR QUALITY ENHANCEMENT OF CODED SPEECH

RELATED APPLICATIONS

This is a continuation of U.S. application Ser. No. 09/896,062, filed Jun. 29, 2001 now U.S. Pat. 6,941,263, and titled "FREQUENCY DOMAIN POSTFILTERING FOR QUALITY ENHANCEMENT OF CODED SPEECH", which is hereby incorporated herein by reference.

TECHNICAL FIELD

This invention is related in general to the art of signal filtering for enhancing the quality of a signal, and more particularly to a method of postfiltering a synthesized speech signal to provide a speech signal of improved quality.

BACKGROUND

Electronic signal generation is pervasive in all areas of electronic and electrical technology. When an electrical signal is used to emulate, transmit, or reproduce a real world quantity, the quality of the signal is important. For example, speech is often received via a microphone or other sound transducer and transformed into an electrical representation or signal. In addition to the artificial noise introduced as an artifact of this transformation, other artificial noise may be additionally introduced into the signal during transmission, and coding and/or decoding. Such noise is often audible to humans, and in fact may dominate a reproduced speech signal to the point of distracting or annoying the listener.

Speech coders, particularly those operating at low bit rates, tend to introduce quantization noise that may be audible and thereby impair the quality of the recovered speech. A postfilter is generally used to mask noise in coded speech signals by enhancing the formants and fine structure of such signals. Typically, noise in strong formant regions of a signal is inaudible, whereas noise in valley regions between two adjacent formants of a signal is perceptible since the signal to noise ratio (SNR) in valley regions is low. The SNR in the valley region may be even lower in the context of a low bit rate codec, since the prevailing linear prediction (LP) modeling methods represent the peaks more accurately than the valleys, and the available bits are insufficient to adequately represent the signal in the valleys. Thus, it is desirable that a speech postfilter attenuates the valleys while preserving the peaks in order to reduce the audible noise level.

Juin-Hwey Chen et al. have proposed an adaptive postfiltering algorithm consisting of a pole-zero long-term postfilter cascaded with a short-term postfilter. The short-term postfilter is derived from the parameters of the LP model in such a way that it attenuates the noise in the spectrum valleys. These parameters are commonly referred to as linear predictive coding coefficients, or LPC coefficients, or LPC parameters. Additionally, Wang et al. introduced a frequency domain adaptive postfiltering algorithm to suppress noise in spectrum valleys. The aforementioned postfiltering algorithms reduce noise without introducing substantial spectral distortion, but they are not efficient in reducing the perceptible noise in shallow, rather than deep, valleys between formants, especially in the context of low bit-rate coders such as those operating at below 8 kbps. A primary explanation for this drawback is that the frequency response of the postfilter itself does not adequately follow the detailed fine structure of the spectral envelope, leading to the masking of shallow valleys between closely-spaced formants.

A typical early time domain LPC postfiltering architecture is illustrated in FIG. 1. An input bit-stream, perhaps transmitted from an encoder, is received at decoder 100. A bit-stream decoder 110 associated with decoder 100 decodes the incoming bit-stream. This step yields a separation of the bit stream into its logical components or virtual channel contents. For example, the bit stream decoder 110 separates LPC coefficients from a coded excitation signal for linear prediction-based codecs. The decoded LPC coefficients are transmitted to a formant filter 131, which is the first stage of a time domain postfilter 130. A synthesized speech signal produced by a speech synthesizer 120 is input to the formant filter 131 followed by a pitch filter 132 wherein the harmonic pitch structure of the signal is enhanced. Cascaded with the pitch filter, a tilt compensation module 133 is generally provided for removing the background tilt of the formant filter to avoid undesirable distortion of the postfilter. Finally, a gain control is applied to the signal in gain controller 134 to eliminate discontinuity of signal power in adjacent frames.

The frequency response of the postfilter architecture represented in prior speech postfiltering systems does not adequately follow the detailed fine structure of the speech spectrum nor does it always adequately resolve the spectral envelope peaks and valleys.

SUMMARY

This invention provides a method of postfiltering in the frequency domain, wherein the postfilter is derived from the LPC spectrum. Furthermore, for enhancing the spectral structure efficiently, a non-linear transformation of the LPC spectrum is applied to derive the postfilter. To avoid uneven spectral distension due to a nonlinear transformation of the background spectral tilt, tilt calculation and compensation is preferably conducted prior to application of the formant postfilter. Finally, to avoid aliasing, the invention provides an anti-aliasing procedure in the time domain. Initial implementation results have shown that this method significantly improves the signal quality, especially for those portions of the signal attributable to low power regions of the speech spectrum.

In general, signal filtering of speech and other signals may be performed in the time domain or-the frequency domain. In the time domain, filter application is equivalent to performing a convolution combining a vector representative of the signal and a vector representative of an impulse response of the filter respectively, to produce a third vector corresponding to the filtered signal. In contrast, in the frequency domain, the operation of applying a filter to a signal is equivalent to simple multiplication of the spectrum of the signal by that of the filter. Thus, if the spectrum of the filter preserves the spectrum of the signal in detail, filtering of the signal preserves the fine structure and formants of the signal. In particular, a valley present in the speech spectrum will never completely disappear from the filtered spectrum, nor will it be transformed into a local peak instead of a valley. This is because the nature of the inventive postfilter preserves the ordering of the points in the spectrum; a spectral point that is greater than its neighbor in the pre-filter spectrum will remain greater in the filtered spectrum, although the degree of difference between the two may vary due to the filter.

Thus, the postfilter described herein employs a frequency response that follows the peaks and valleys of the spectral envelope of the signal without producing overall spectrum tilt. Such a postfilter may be advantageously employed in a variety of technical contexts, including cell phone transmission and reception technology, Internet media technology, and other storage or transmission contexts involving low bit-rate codecs.

DESCRIPTION OF THE PREFERRED EMBODIMENTS

The present invention is generally directed to a method and system of performing postfiltering for improving speech quality, in which a postfilter is derived from a non-linear transformation of a set of LPC coefficients in the frequency domain. The derived postfilter is applied by multiplying the synthesized speech signal by formant filter gains in the frequency domain. In one embodiment, the invention is implemented in a decoder for postfiltering a synthesized speech signal. According to alternate embodiments of the invention, the LPC coefficients used for deriving the postfilter may be transmitted from an encoder or may be independently derived from the synthesized speech in the decoder.

Although it is not required, the present invention may be implemented using instructions, such as program modules, that are executed by a computer. Generally, program modules include routines, objects, components, data structures and the like that perform particular tasks or implement particular abstract data types. The term "program" includes one or more program modules.

The invention may be implemented on a variety of types of machines, including cell phones, personal computers (PCs), hand-held devices, multi-processor systems, microprocessor-based programmable consumer electronics, network PCs, minicomputers, mainframe computers and the like. The invention may also be employed in a distributed system, where tasks are performed by components that are linked through a communications network. In a distributed system, cooperating modules may be situated in both local and remote locations.

Figure 1:
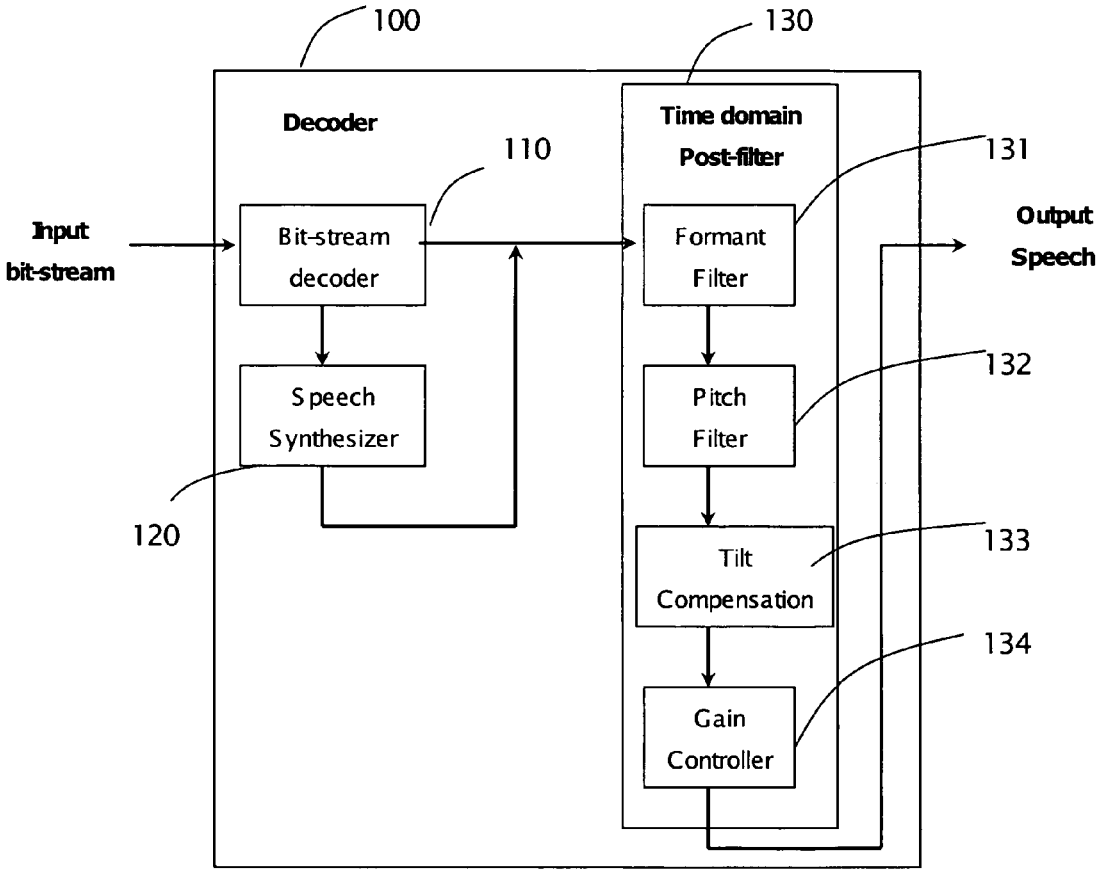
FIG. 1 Prior Art
FIG. 1 is a schematic view showing a typical prior art time domain-postfiltering architecture.
Figure 2:
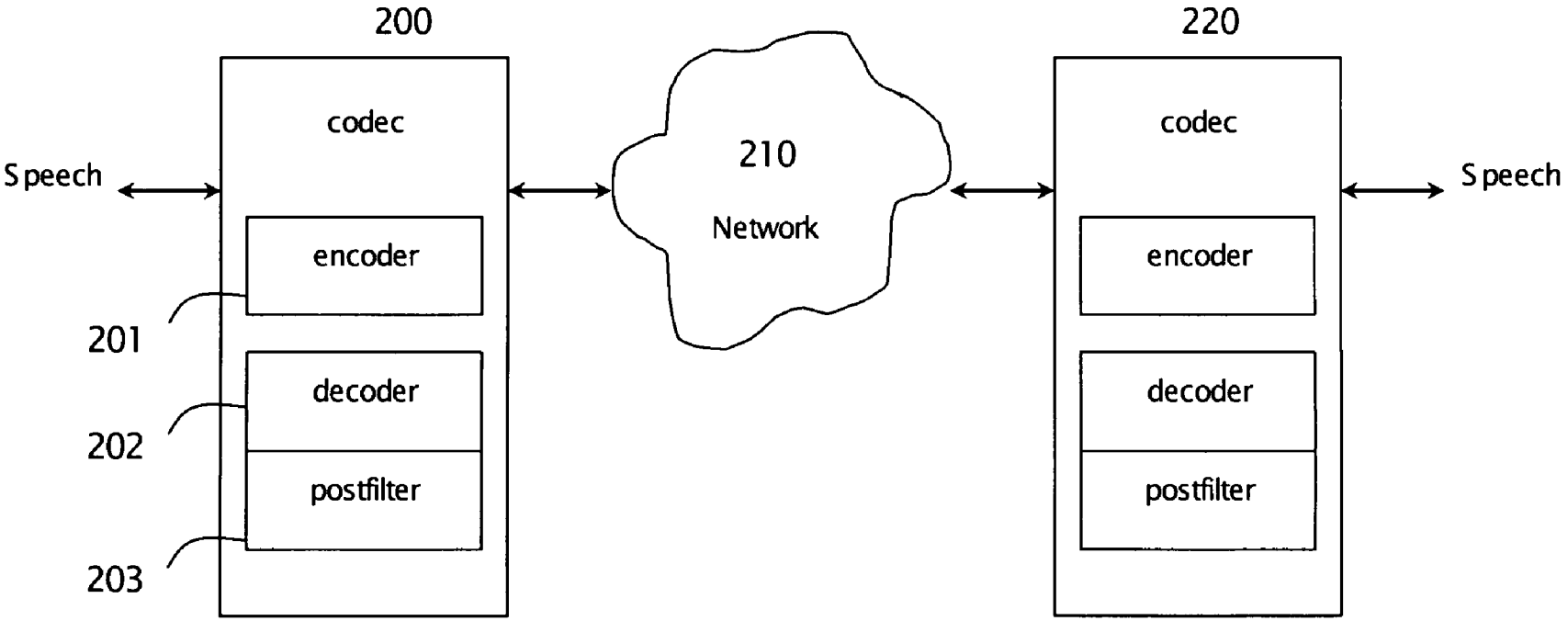
FIG. 2 is an architectural diagram of network linked codecs.

An exemplary telephony system in which an embodiment of the invention may be used is described with reference to FIG. 2. The telephony system comprises codecs 200, 220 communicating with one another over a network 210, represented by a cloud. Network 210 may include many well-known components, such as routers, gateways, hubs, etc. and may allow the codecs 200 to communicate via wired and/or wireless media. Each codec 200, 220 in general comprises an encoder 201, a decoder 202 and a postfilter 203.

Codecs 200 and 220 preferably also contain or are associated with a communication connection that allows the hosting device to communicate with other devices. A communication connection is an example of a communication medium. Communication media typically embody computer readable instructions, data structures, program modules or other data in a modulated data signal such as a carrier wave or other transport mechanism and include any information delivery media. The term computer readable media as used herein includes both storage media and communication media. The codec elements described herein may reside entirely in a computer readable medium. Codecs 200 and 220 may also be associated with input and output devices such as will be discussed in general later in this specification.

Figure 3:
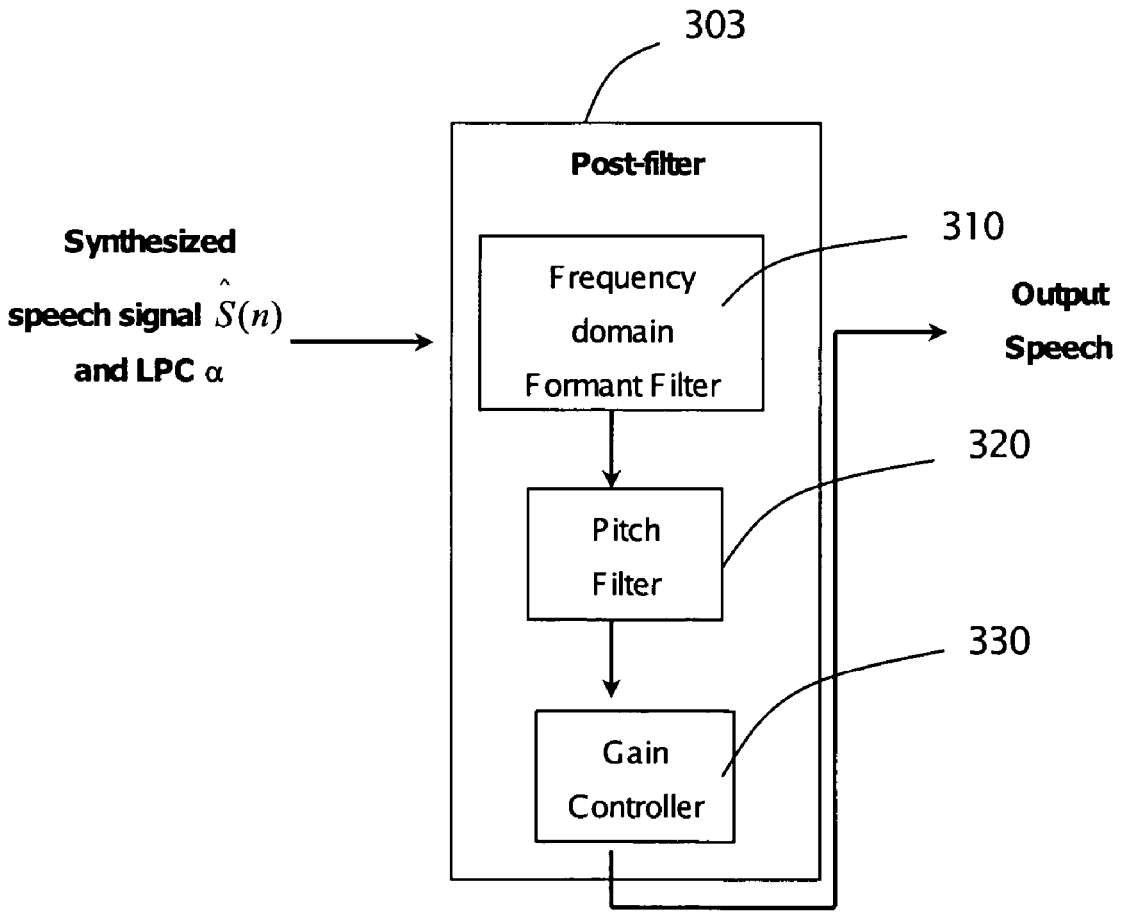
FIG. 3 is a simplified structural schematic of a frequency domain postfilter according to an embodiment of the invention.

Referring to FIG. 3, an exemplary postfilter 303 on which the system described herein may be implemented is shown. In its most basic configuration, the postfilter 303 utilizes an input synthesized speech signal $\hat{S}(n)$ and LPC coefficients $\alpha$, in conjunction with a frequency domain formant filter 310. The postfilter may also have additional features or functionality. For example, a pitch filter 320 and a gain controller 330 are preferably also implemented and utilized as will be described hereinafter.

It is known that the encoding and decoding of a speech signal typically will introduce unwanted noise into the signal. In the signal frequency spectrum, such noise overlaps the speech signal and is particularly audible to humans in valley regions between consecutive formants. A properly designed and implemented postfilter will aid in removing this unwanted noise. An ideal postfilter is one that has a frequency response that follows the frequency spectrum of the signal of interest. Most current codecs are based on the principle of linear prediction, wherein the coefficients of the linear prediction follow the signal frequency spectrum. In addition to other innovative procedures to be discussed, the invention takes advantage of this relationship to derive a speech postfilter, although the invention also allows for the independent generation of LPC parameters.

There are a wide variety of ways in which frequency domain postfiltering may be performed in accordance with the invention. According to one embodiment, frequency domain postfiltering is performed sequentially within the postfilter. Referring to FIG. 4*a*, the frequency domain formant filter 410 comprises a Fourier transformation module 411, a formant filtering module 412 and an inverse Fourier transformation module 413. The Fourier transformation and the inverse Fourier transformation modules are available to the formant filtering module 412 to transfer signals between the time domain and the frequency domain, as will be appreciated by those of skill in the art. The Fourier and inverse Fourier transformations of the transformation modules 411 and 413 are preferably executed according to the standard Discrete Fourier Transformation (DFT).

The formant filtering module 412 generates frequency domain gains and filters the input synthesized speech signal by applying the generated gains before transforming the subject signal back to the time domain. FIG. 4*b* further illustrates the components of the formant filtering module 412, which comprises a LPC tilt computation module 415, a LPC tilt compensation module 420, a gain computation module 430 and a gain application module 440. The operation of these modules is described in greater detail below with respect to FIG. 6, but will be described here briefly as well.

In general, an encoded LPC spectrum has a tilted background. This tilt may result in unacceptable signal distortion if used to compute the postfilter without tilt compensation. In particular, this tilted background could be undesirably amplified during postfiltering when the postfilter involves a non-linear transformation as in the present invention. Application of such a transformation to a tilted spectrum would have the effect of nonlinearly transforming the tilt as well, making it more difficult to later obtain a properly non-tilted spectrum. Thus it is preferable to remove the background tilt of the spectrum prior to the nonlinear transformation. According to the invention, the tilt compensation module 420 properly removes the tilted background according to the tilt estimated by the LPC spectrum tilt computation module 415.

The gain computation module 430 calculates the frequency domain formant filter gains including magnitude and phase response. At this point, the gain application module 440 applies the gains multiplicatively to the speech signal in the frequency domain.

Figure 4C:
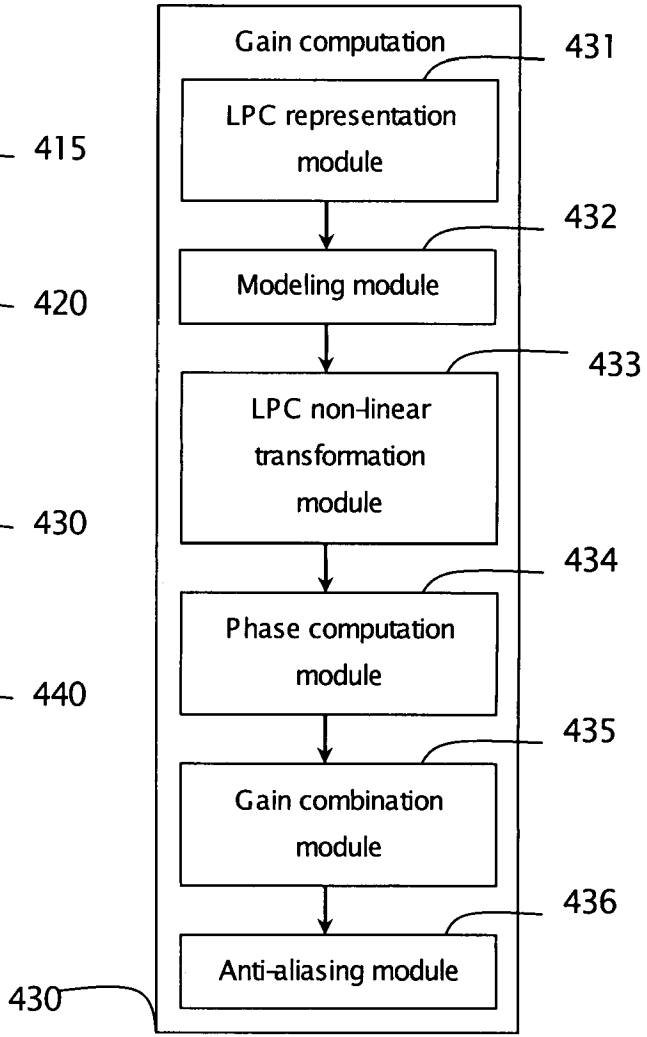
FIGS. 4*a*, 4*b* and 4*c* are structural schematics illustrating components of a frequency domain formant filter according to an embodiment of the invention.
Figure 4B:
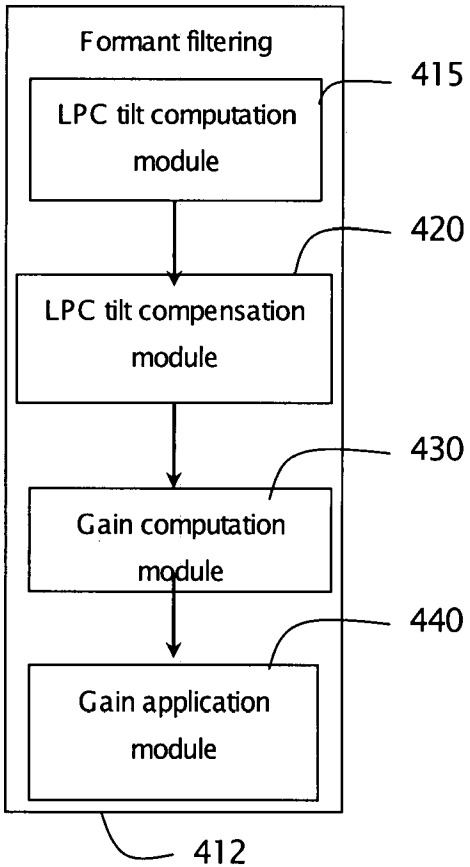
Figure 4A:
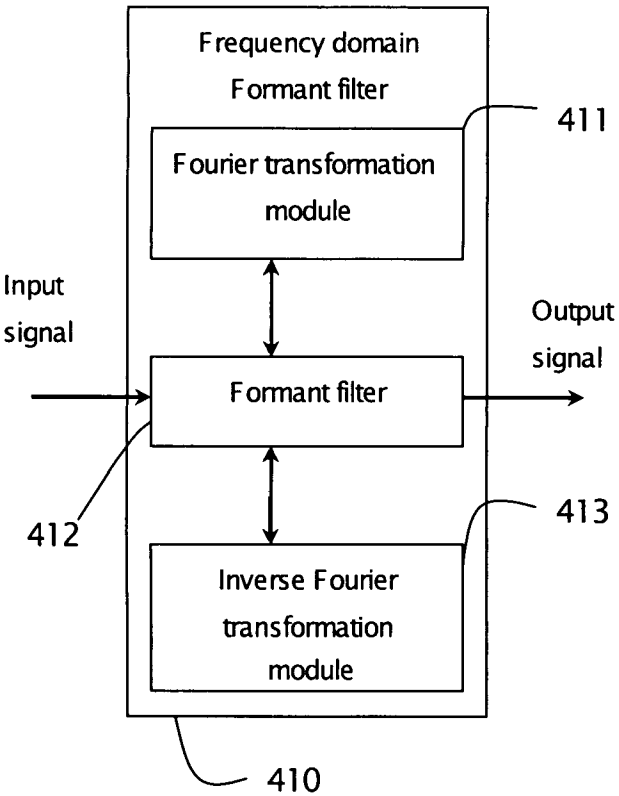

Referring to FIG. 4*c*, the gain computation module comprises a time domain LPC representation module 431, a modeling module 432, a LPC non-linear transformation module 433, a phase computation module 434, a gain combination module 435, and an anti-aliasing module 436.

LPC representation module 431 creates a time domain vector representation of the LPC spectrum, after which the vector is transformed into the frequency domain for further processing. The modeling module 432 models the frequency domain vector based on one of a number of suitable models known to those of skill in the art. In an embodiment of the invention, the inverse of the LPC spectrum is used to calculate the gains.

The LPC non-linear transformation module 433 calculates the magnitude of the formant filter gains by conducting a non-linear transformation of the magnitude of the inverse LPC spectrum. According to one embodiment of the invention, a scaling function with a scaling factor of between 0 and 1 is used as a non-linear transformation function, as will be described in greater detail below. The parameters in the scaling function are adjustable according to dynamic environments, for example, according to the type of input speech signal and the encoding rate. The phase computation module 434 calculates the phase response for the formant filter gains. According to one embodiment, the phase computation module 434 calculates the phase response via the Hilbert transform, in particular, the phase shifter. Other phase calculators, for example the Cotangent transform implementation of the Hilbert transform may alternatively be used. Using the magnitude and the phase of the formant filter gains provided by the LPC non-linear transformation module 433 and the phase computation module 434, the gain combination module 435 generates the gains in the frequency domain. An anti-aliasing module 436 is preferably provided to avoid aliasing when postfiltering the signal. It is preferred, but not essential, to conduct the anti-aliasing operation in the time domain.

According to the invention, the frequency domain postfilter is derived from the LPC spectrum and generates, for example, the frequency domain formant gains, wherein the derivation involves a sequence of mathematic procedures. It may be desirable to provide a separate calculation unit that is responsible for all or a portion of the mathematical processing. In another embodiment of the invention, a separate LPC evaluation unit is provided to derive the LPC coefficients as shown in FIG. 5.

Figure 5B:
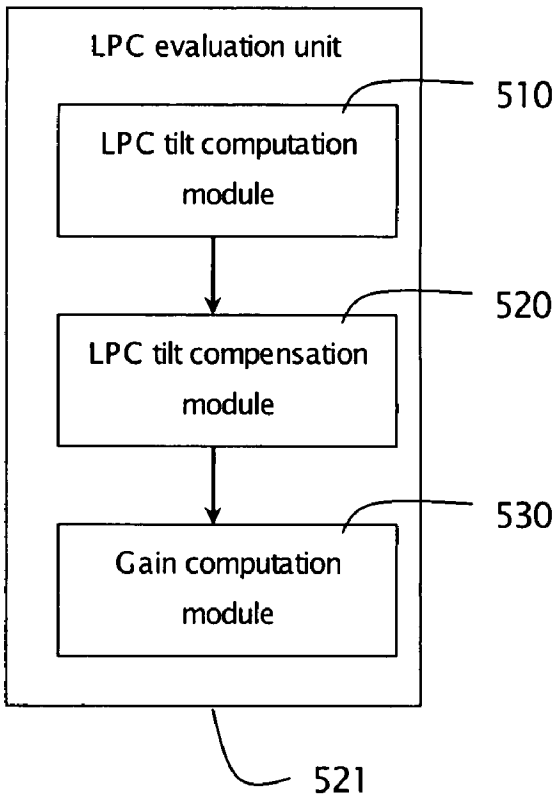
FIGS. 5*a* and 5*b* are structural schematics illustrating components of a frequency domain formant filter according to an alternative embodiment of the invention.
Figure 5A:
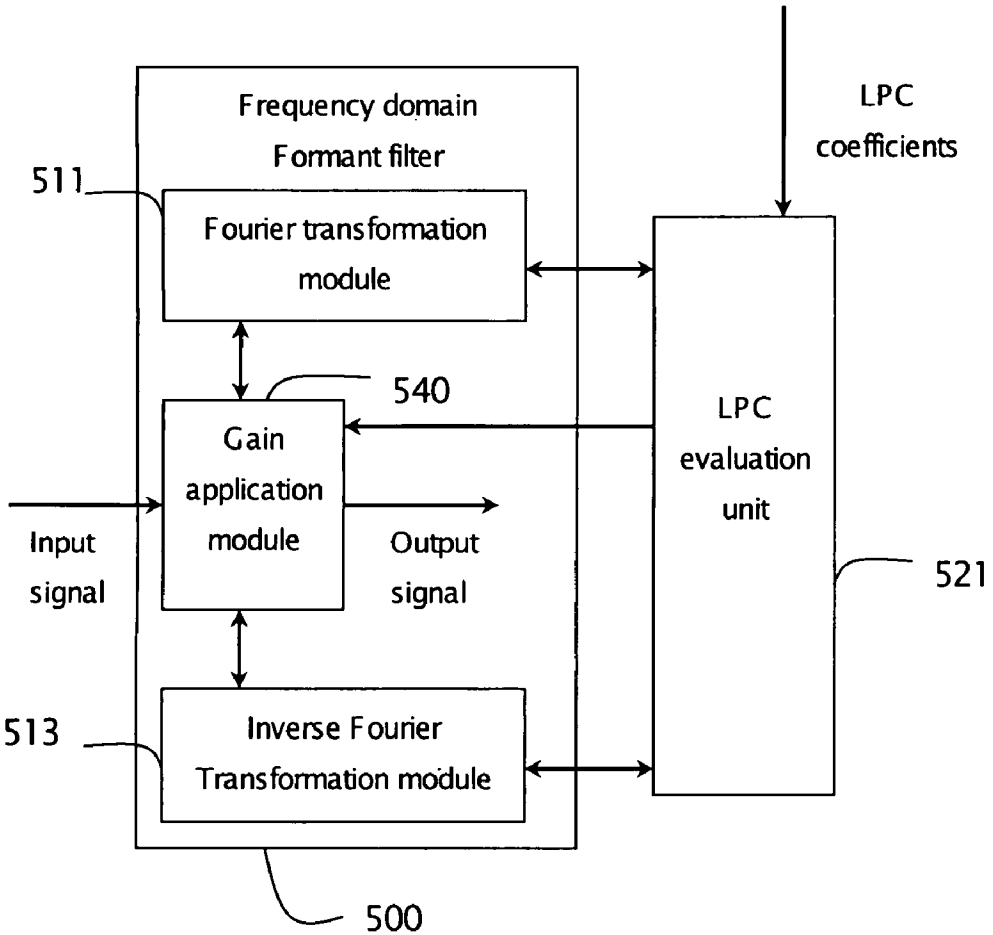

Referring to FIG. 5, the frequency domain formant filter 500 comprises a Fourier transformation module 511, an inverse Fourier transformation module 513, a gain application module 540 and a LPC evaluation unit 521. The Fourier transformation module 511, inverse Fourier transformation module 513 and the gain application module 540 may be the same as the modules referred to by similar numbers in FIG. 4. According to the invention, the LPC evaluation unit 521 comprises a LPC tilt computation module 510, a LPC tilt compensation module 520 and a gain computation module 530, wherein these components may be same as the components referenced by the similar numbers in FIG. 4.

In operation, the alternative embodiment described in FIG. 5 varies slightly from the embodiment illustrated by way of FIG. 4. In particular, the gain application module 540 receives as input a synthesized speech signal and provides as output a filtered synthesized speech signal. Fourier and inverse Fourier transform modules 511 and 513 are available to the gain application module for transformation of the pre-filtered speech signal into the frequency domain, and for transformation of the post-filtered speech signal into the time domain. LPC evaluation unit 521 receives or calculates the LPC coefficients, accesses the transformation modules 511 and 513 when necessary for transformation between the time and frequency domains, and returns computed gains to the gain application module 540.

Figure 6A:
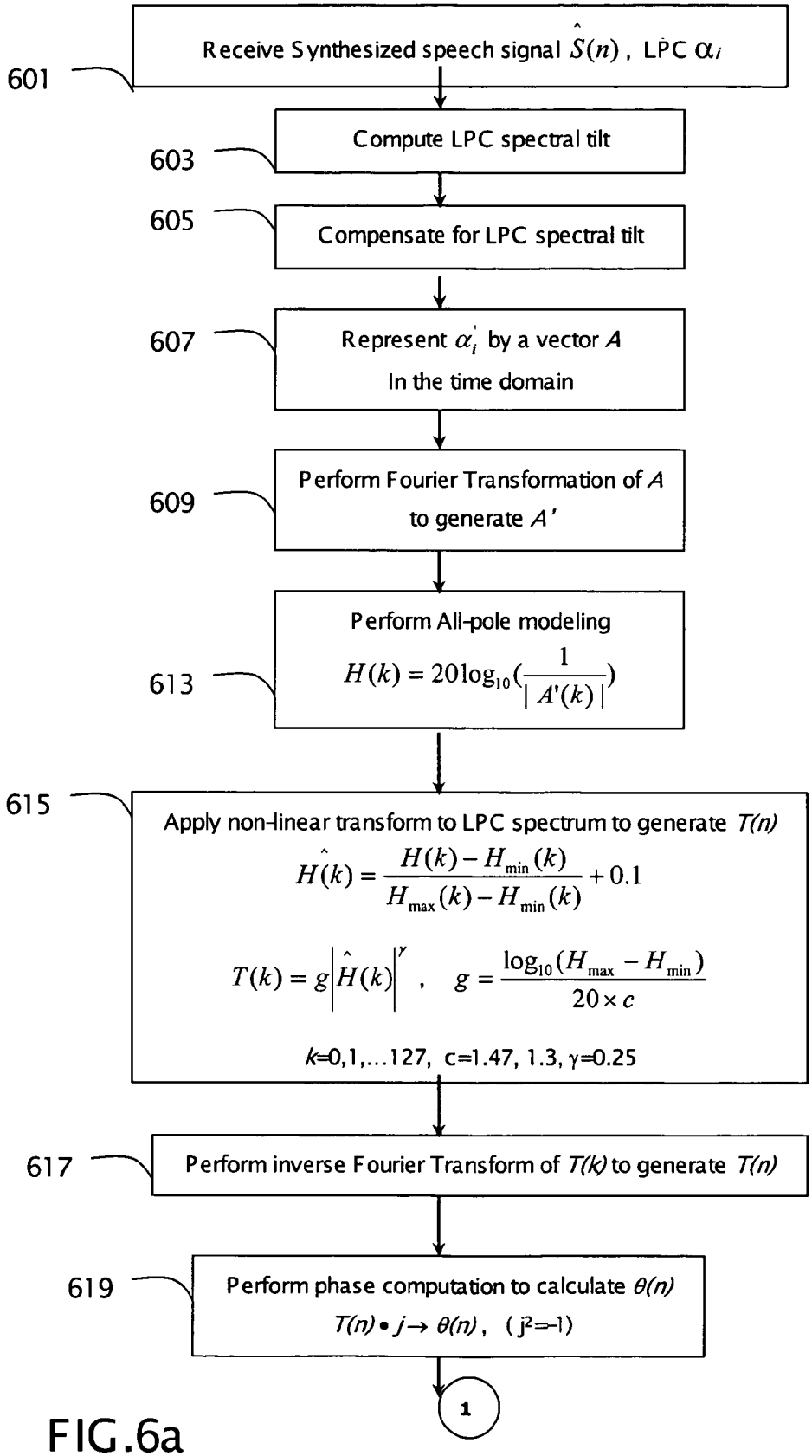
FIGS. 6*a* and 6*b* are flow charts demonstrating steps executed in performing postfiltering according to an embodiment of the invention.
Figure 6B:
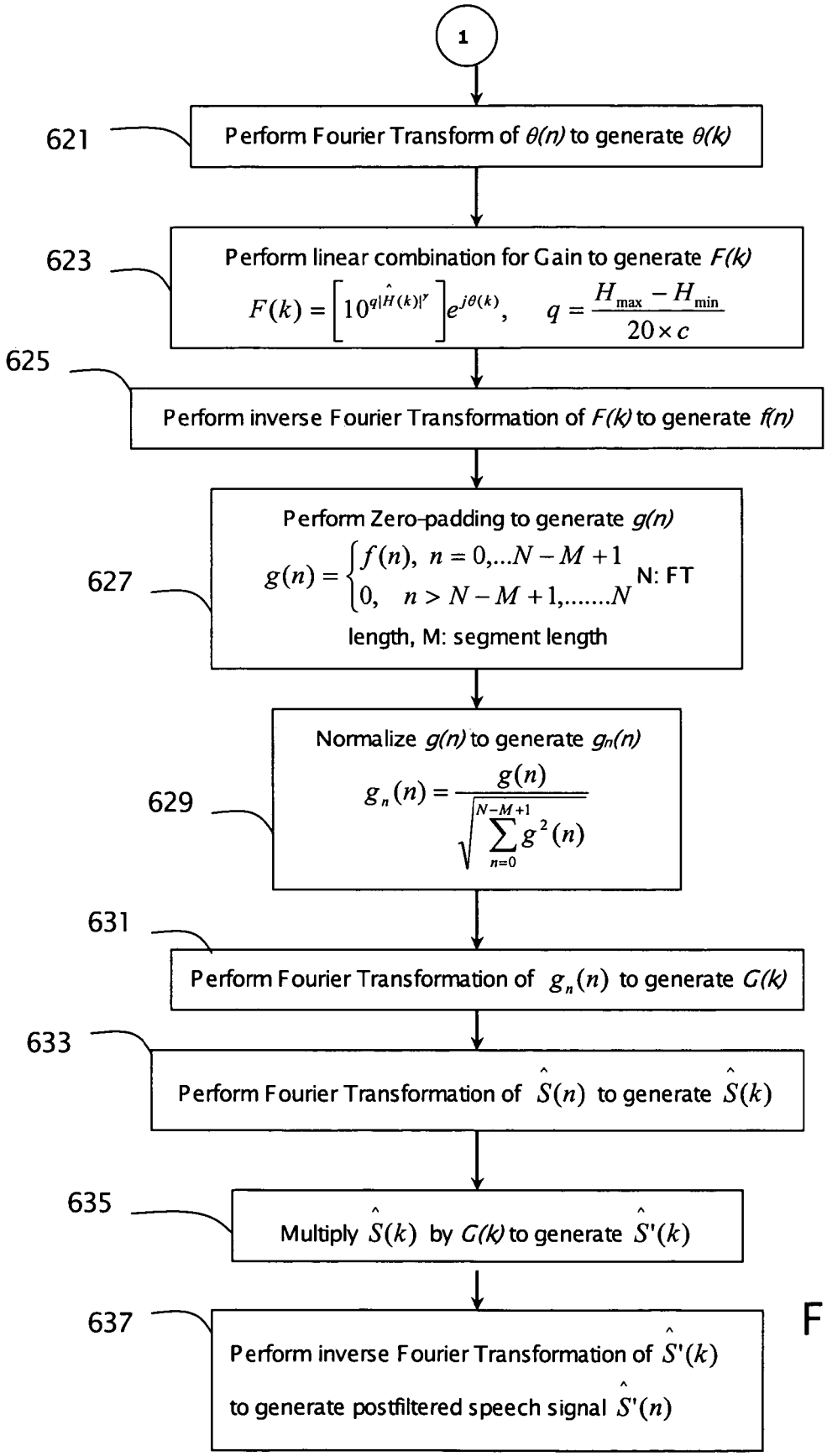

Referring to FIGS. 6*a* and 6*b*, exemplary steps taken to perform postfiltering in accordance with an embodiment of the invention are illustrated. The synthesized speech signal $\hat{S}(n)$ and the LPC coefficients $\alpha_i$ are received at step 601. Because an encoded LPC spectrum generally has a tilted background that induces extra distortion when used directly to compute formant postfilter, it is preferable to first compute and correct for any spectral tilt. Uncorrected tilt may be undesirably amplified during the computation of the postfilter, especially when such computation involves a non-linear transformation. Accordingly, at steps 603 and 605, respectively, the LPC spectrum tilt is calculated and the spectrum compensated therefor. Exemplary mathematic procedures usable to execute these steps are as follows. Those of skill in the art will recognize that the following mathematical procedures may be modified in arrangement and detail and yet achieve the same result. For LPC coefficients $\alpha_i$ (i=0,1 . . . P and $\alpha_0$=1), where P is the order of the LPC polynomial coefficients, the tilt μ of the LPC spectrum is defined as:

$$\mu = \frac{R(1)}{R(0)}$$

where R(1) and R(0) are autocorrelation values of the LPC parameters defined by $$R(\tau) = \sum_{i=0}^{i=P-\tau} \alpha_i \alpha_{i+\tau} \quad \tau = 0, 1$$

The LPC order P is selected depending on the sample frequency as will be apparent to those of skill in the art. In this embodiment, P=10 is used for 8 kHz and 11.025 kHz sampling rates, while P=16 is used for 16 kHz and 22.05 kHz sampling rates. Given the calculated tilt μ, the LPC coefficients $\alpha_1$ are compensated as follows:

$$\alpha_i' = \begin{cases} \alpha_0 & i = 0 \\ \alpha_i - 0.7\mu\alpha_{i-1} & i = 1, \ldots p \\ -0.7\mu\alpha_p & i = p+1 \end{cases}$$

At step 607, a vector representation denoted by A of the tilt compensated LPC $\alpha_i$ in the time domain is obtained by zero-padding to form a convenient size vector. An exemplary length for such a vector is 128, although other similar or quite different vector lengths may equivalently be employed.

At steps 609 to 623 the formant postfilter gains including magnitude and phase response are calculated. In particular, at step 609, the vector A is transformed to a frequency domain vector A'(k) via a Fourier transformation. At step 613, the frequency domain vector A'(k) is modified by inversing the magnitude of the A'(k) and converting to log scale (dB). The transfer function according to this step is denoted by H(k). For mathematical efficiency and convenience, H(k) is first normalized in step 615 to $\hat{H}(k)$, as in the following example:

$$\hat{H}(k) = \frac{H(k) - H_{\min}(k)}{H_{\max}(k) - H_{\min}(k)} + 0.1$$

where $H_{max}(k)$ and $H_{min}(k)$ represent the maximum and the minimum values of H(k), respectively.

In step 615, the normalized function $\hat{H}(k)$ is non-linearly transformed through a scaling function such as the following:

$$T(k) = g\left|\hat{H}(k)\right|^{\gamma},\ g = \frac{\ln 10}{20c}(H_{\max} - H_{\min})$$

where c is a constant. An exemplary value of c is 1.47 for a voiced signal, and 1.3 for an unvoiced signal. The scaling factor γ may be adjusted according to dynamic environmental conditions. For example, different types of speech coders and encoding rates may optimally use different values for this constant. An exemplary value for the scaling factor γ is 0.25, although other scaling factors may yield acceptable or better results. Even though the present invention has been described as utilizing the above scaling function for the step of non-linear transformation, other non-linear transformation functions may alternatively be used. Such functions include suitable exponential functions and polynomial functions.

The function T(k) obtained in step 615 is then used to estimate the phase response of the gain. In accordance with the invention, steps 617 to 623 implement the Hilbert phase shifter to calculate the phase response θ(k) of the gain. In particular, at step 617, the function T(k) is transferred into the time domain by conducting the Fourier transformation, since the Hilbert phase shifter is conducted in the time domain. At step 619, The phase response θ(n) is obtained by multiplying T(n) with j, wherein j is defined as $j^2=-1$. At step 621, the calculated phase response of the gains θ(n) are transformed into the frequency domain phase response θ(k) for further processing in the frequency domain.

At step 623, the frequency domain formant filter gain F(k) is obtained by combining the magnitude and phase components as follows:

$$F(k)=L(k)e^{j\theta(k)},\ L(k)=10^{q/gT(k)}$$

where q and g are constants defined as:

$$q = \frac{H_{\max} - H_{\min}}{20c},\ g = \frac{\ln 10}{20c}(H_{\max} - H_{\min})$$

wherein ln is the natural logarithm.

Steps 625 to 631 are executed to conduct anti-aliasing in the time domain. In particular, in step 625, the frequency domain gain F(k) is transformed to a time domain gain f(n) through execution of an inverse Fourier transformation. That is, the Inverse Fourier transformation of F(k) equals f(n). In step 627, a second function g(n) is defined by zeroing the coefficients of f(n) according to the Fourier transformation length N and the input speech segment length M as follows:

$$g(n) = \begin{cases} f(n) & n = 0, 1 \ldots N - M \\ 0 & n > N - M \end{cases}$$

Step 629 entails applying a standard normalization procedure to g(n) as follows:

$$g_n(n) = \frac{g(n)}{\sqrt{\sum_{n=0}^{N-M} g^2(n)}}$$

Finally, the frequency domain gain G(k) after anti-aliasing is obtained by transferring the time domain function $g_n(n)$ into the frequency domain through a Fourier transformation in step 631. That is, the Fourier transformation of $g_n(n)$ equals G(k).

Having calculated the frequency domain formant gain G(k), steps 633 to 637 are executed to effect filtering of the input synthesized speech signal $\hat{S}(n)$. In particular, in step 633, the signal $\hat{S}(n)$ is first transferred into a frequency domain signal $\hat{S}(k)$. Recalling that postfiltering in the frequency domain is implemented by multiplication of the signal by a gain for each frequency, $\hat{S}(k)$ is multiplied in step 635 by the frequency domain formant filter gains G(k) and the postfiltered speech signal $\hat{S}'(k)$ is then obtained. By then transforming $\hat{S}'(k)$ into the time domain in step 637, a postfiltered speech signal $\hat{S}'(n)$ is obtained.

Figure 7:
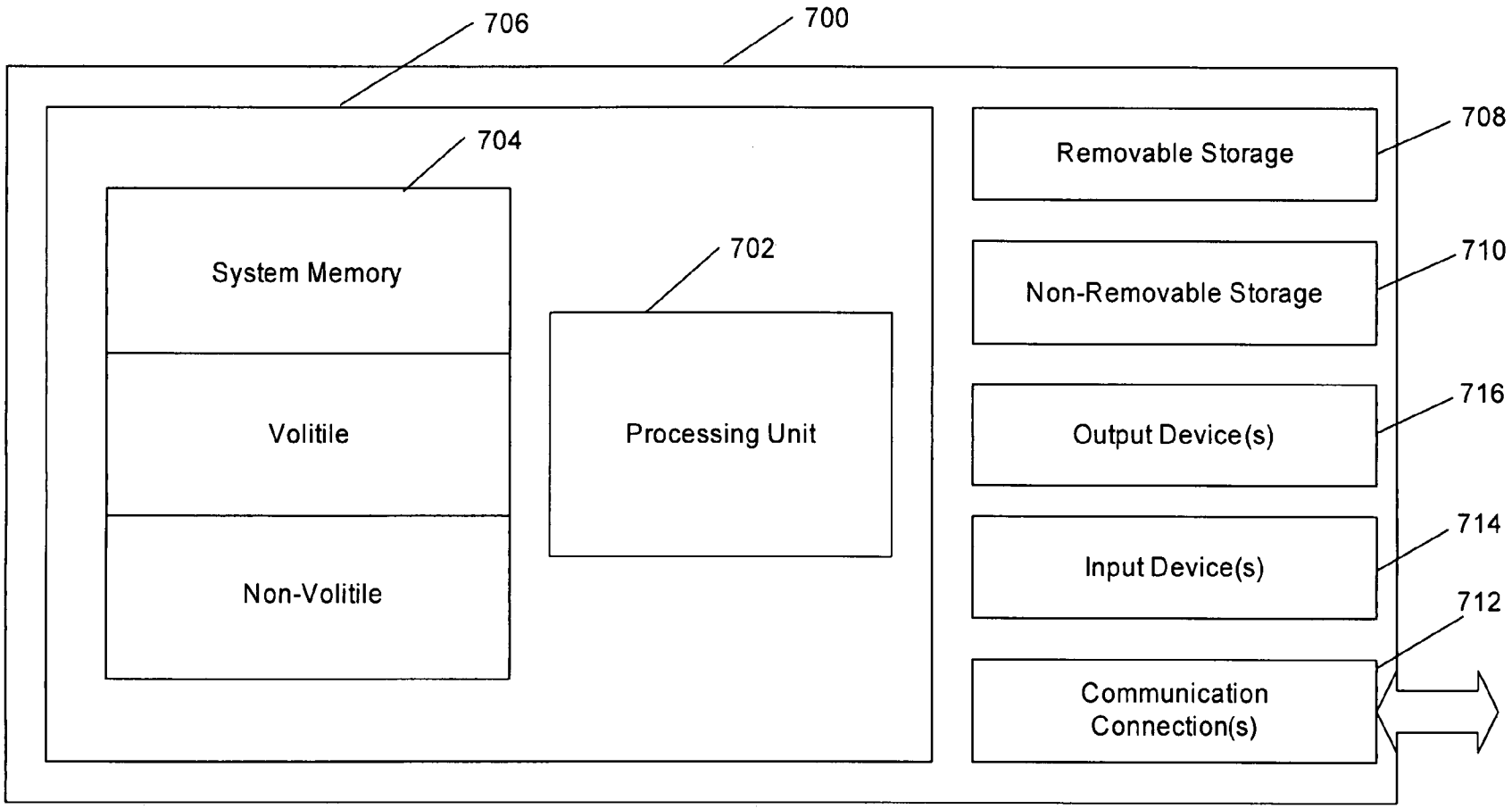
FIG. 7 is a simplified schematic illustrating a computing device architecture employed by a computing device upon which an embodiment of the invention may be executed.

With reference to FIG. 7, one exemplary system for implementing embodiments of the invention includes a computing device, such as computing device 700. In its most basic configuration, computing device 700 typically includes at least one processing unit 702 and memory 704. Depending on the exact configuration and type of computing device, memory 704 may be volatile (such as RAM), non-volatile (such as ROM, flash memory, etc.) or some combination of the two. This most basic configuration is illustrated in FIG. 7 by line 706. Additionally, device 700 may also have additional features/functionality. For example, device 700 may also include additional storage (removable and/or non-removable) including, but not limited to, magnetic or optical disks or tape. Such additional storage is illustrated in FIG. 7 by removable storage 708 and non-removable storage 710. Computer storage media includes volatile and nonvolatile, removable and non-removable media implemented in any method or technology for storage of information such as computer readable instructions, data structures, program modules or other data. Memory 704, removable storage 708 and non-removable storage 710 are all examples of computer storage media. Computer storage media includes, but is not limited to, RAM, ROM, EEPROM, flash memory or other memory technology, CDROM, digital versatile disks (DVD) or other optical storage, magnetic cassettes, magnetic tape, magnetic disk storage or other magnetic storage devices, or any other medium which can be used to store the desired information and which can be accessed by device 700. Any such computer storage media may be part of device 700.

Device 700 may also contain one or more communications connections 712 that allow the device to communicate with other devices. Communications connections 712 are an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. As discussed above, the term computer readable media as used herein includes both storage media and communication media.

Device 700 may also have one or more input devices 714 such as keyboard, mouse, pen, voice input device, touch input device, etc. One or more output devices 716 such as a display, speakers, printer, etc. may also be included. All these devices are well known in the art and need not be discussed at greater length here.

It will be appreciated by those of skill in the art that a new and useful method and system of performing postfiltering have been described herein. In view of the many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. For example, the invention is described as employing a scaling function with the scaling factor being between 0 and 1 for non-linear transformation. However, other transformation functions and factors may also be employed. For example, exponential and polynomial functions may also be used within the invention. Further, although the Hilbert phase shifter is specified for calculating the phase response of the gain, other techniques for calculating the phase response of a function may also be used, such as the Cotangent transform technique. In conducting time domain to frequency domain transformation, this specification prescribes the DFT, but other transformation techniques may equivalently be employed, such as the Fast Fourier Transformation (FFT), or even a standard Fourier transformation. Although the invention is described in terms of software modules or components, those skilled in the art will recognize that such may be equivalently replaced by hardware components. Therefore, the invention as described herein contemplates all such embodiments as may come within the scope of the following claims and equivalents thereof.

What is claimed is:

1. A method of postfiltering a synthesized speech signal, comprising:

representing linear predictive coefficients of the synthesized speech signal as a time domain vector;

transforming the time domain vector into a frequency domain vector;

transferring the frequency domain vector into an all-pole model vector;

calculating gains according to a magnitude of the all-pole model vector, wherein the gains include a magnitude and phase response; and applying the calculated gains to the synthesized speech signal in the frequency domain.

2. A method as recited in claim 1, further comprising:

compensating the linear predictive coefficients using a tilt of a spectrum of the linear predictive coefficients before representing the linear predictive coefficients as a time domain vector.

3. A method as recited in claim 1, further comprising:

performing anti-aliasing on the gains before applying the gains to the synthesized speech signal.

4. A method as recited in claim 1, further comprising:

performing anti-aliasing on the gains in the time domain before applying the gains to the synthesized speech signal.

5. A method as recited in claim 1, wherein transforming the time domain vector into a frequency domain vector is carried out using a Fourier transformation.

6. A method as recited in claim 1, further comprising:

computing a tilt of a spectrum of the linear predictive coefficients in the time domain; and compensating the linear predictive coefficients using the computed tilt in the time domain.

7. A method as recited in claim 1, wherein the all-pole model is represented by a logarithm of the inverse of the magnitude of the frequency domain vector.

8. A method of postfiltering a speech signal, comprising:

calculating formant filter gains for linear predictive coefficients of the speech signal by performing a non-linear transformation of the linear predictive coefficients in the frequency domain, the gains include a magnitude and phase response; and multiplying the formant filter gains and the speech signal in the frequency domain.

9. A method as recited in claim 8, further comprising performing anti-aliasing on the formant filter gains before multiplying the formant filter gains and the speech signal.

10. A method as recited in claim 8, further comprising compensating the linear predictive coefficients using a tilt of a spectrum of the linear predictive coefficients before calculating formant filter gains.

11. A method as recited in claim 8, further comprising:

computing a tilt of a spectrum of the linear predictive coefficients in the time domain; and compensating the linear predictive coefficients using the computed tilt in the time domain.

12. A method as recited in claim 8, wherein the phase response is determined using a Hilbert transform.

13. A computer-readable medium having embodied thereon computer-readable instructions that, when executed by one or more possessors, implement a process comprising:

representing linear predictive coefficients of a synthesized speech signal as an all-pole model vector;

calculating gains according to a magnitude of the all-pole model vector, wherein the gains include a magnitude and phase response; and applying the calculated gains to the speech signal in the frequency domain.

14. A computer-readable medium as recited in claim 13, wherein representing linear predictive coefficients of a synthesized speech signal as an all-pole model vector comprises:

representing the linear predictive coefficients as a time domain vector;

transforming the time domain vector into a frequency domain vector; and transferring the frequency domain vector into an all-pole model vector.

15. A computer-readable medium as recited in claim 14, wherein the method further comprises:

compensating the linear predictive coefficients using a tilt of a spectrum of the linear predictive coefficients before representing the linear predictive coefficients as a time domain vector.

16. A computer-readable medium as recited in claim 13, wherein the method further comprises:

performing anti-aliasing on the gains before applying the gains to the speech signal.

17. A computer-readable medium as recited in claim 13, wherein the method further comprises:

performing anti-aliasing on the gains in the time domain before applying the gains to the speech signal.

18. A computer-readable medium as recited in claim 13, wherein the method further comprises:

computing a tilt of a spectrum of the linear predictive coefficients in the time domain; and compensating the linear predictive coefficients using the computed tilt in the time domain.

19. A computer-readable medium as recited in claim 13, wherein an all-pole model is represented by logarithm of the inverse of the magnitude of a frequency domain vector.

20. A computer-readable medium as recited in claim 13, wherein applying the calculated gains to the speech signal in the frequency domain comprises multiplying the calculated gains and the speech signal.

* * * * *